US012662777B2

(12) United States Patent
VanderLinden et al.

(10) Patent No.: US 12,662,777 B2
(45) Date of Patent: Jun. 23, 2026

(54) RAIL TIE HANDLING SYSTEM AND METHOD

(71) Applicant: Transportation IP Holdings, LLC, Norwalk, CT (US)

(72) Inventors: Michael VanderLinden, Knoxville, IA (US); Mark Bachman, Albia, IA (US); Norman Wellings, Agency, IA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 716 days.

(21) Appl. No.: 18/070,340

(22) Filed: Nov. 28, 2022

(65) Prior Publication Data

US 2023/0220632 A1 Jul. 13, 2023

Related U.S. Application Data

(60) Provisional application No. 63/266,630, filed on Jan. 10, 2022.

(51) Int. Cl.
*E01B 29/16* (2006.01)

(52) U.S. Cl.
CPC ..... *E01B 29/16* (2013.01)

(58) Field of Classification Search
CPC ..... E01B 29/00; E01B 29/02; E01B 29/05; E01B 29/06; E01B 29/13; E01B 29/2916
See application file for complete search history.

(56) References Cited

U.S. PATENT DOCUMENTS 3,048,289 A 8/1962 Franklin et al.
3,701,320 A 10/1972 Fearon et al.
5,415,087 A 5/1995 Sniffen, Jr. et al.
6,089,162 A 7/2000 Madison
2020/0270819 A1* 8/2020 Irion ..... E01B 29/26
2020/0385934 A1* 12/2020 Salciccia ..... B65G 37/005

FOREIGN PATENT DOCUMENTS

CN 112482104 A 3/2021
RU 2126473 C1 2/1999

OTHER PUBLICATIONS

Search Report mailed Jul. 12, 2023 for corresponding European Patent Application No. 22213308.4 (6 pages).
Office Action for corresponding Chinese Patent Application No. 202310033177.0, dated Jan. 26, 2026.
Office Action for corresponding Chinese Patent Application No. 202310033177.0, dated Jan. 26, 2026; English Translation.

* cited by examiner

*Primary Examiner* — Robert J McCarry, Jr.
(74) *Attorney, Agent, or Firm* — K&L Gates LLP

(57) ABSTRACT

A rail tie handling system is provided that includes at least one chassis that either has self-propulsion or can be coupled to a vehicle having a propulsion system, or both. The handling system includes a conveyor segment, a bundler segment, and an unloader segment. The conveyor can receive rail ties and to provide them upon demand or request. The bundler can receive rail ties from the conveyor, to bundle the rail ties into a bundle, and to provide the bundle upon demand or request. The unloader can receive the bundle from the bundler and can unload that bundle from the handling system upon demand or request. The system includes a controller that can determine when and/or where to unload the bundle from the unloader.

20 Claims, 3 Drawing Sheets

RAIL TIE HANDLING SYSTEM AND METHOD

CROSS-REFERENCE TO RELATED APPLICATIONS

This application claims priority to U.S. Provisional Application No. 63/266,630 (filed 10 Jan. 2022), the entire disclosure of which is incorporated herein by reference.

TECHNICAL FIELD

Embodiments of the subject matter disclosed herein relate to a system for handling rail ties for rail tracks, and an associated method.

DISCUSSION OF ART

The construction of rail tracks involves the movement and placement of large volumes of materials. These materials may include ballast (rocks and gravel), ties, rails, spikes, and the like. The material may be transported to near where it is intended to be used, and then dumped to be more accurately distributed later. The existing processes are labor intensive, and while some of the dumping has been mechanized, e.g., using a crane, it may be desirable to have a system and method that differs from those that are currently available.

BRIEF DESCRIPTION

In one embodiment, a rail tie handling system is provided. The handling system may include at least one chassis that either has self-propulsion or can be coupled to a vehicle having a propulsion system, or both. The handling system may further include a conveyor segment, a bundler segment, and an unloader segment. The conveyor can receive rail ties and to provide them upon demand or request. The bundler can receive rail ties from the conveyor, to bundle the rail ties into a bundle, and to provide the bundle upon demand or request. The unloader can receive the bundle from the bundler and can unload that bundle from the handling system upon demand or request. The system may include a controller that can determine when and/or where to unload the bundle from the unloader.

A method is provided for operating the handling system. The method, implemented by a controller, may determine a location for where to drop a bundle, may navigate the handling system to the location, may prevent unloading a bundle unless certain criteria are met, and perform one or more other optional tasks.

BRIEF DESCRIPTION OF THE DRAWINGS

The subject matter described herein may be understood from reading the following description of non-limiting embodiments, with reference to the attached drawings, wherein below.

DETAILED DESCRIPTION

Figure 1:
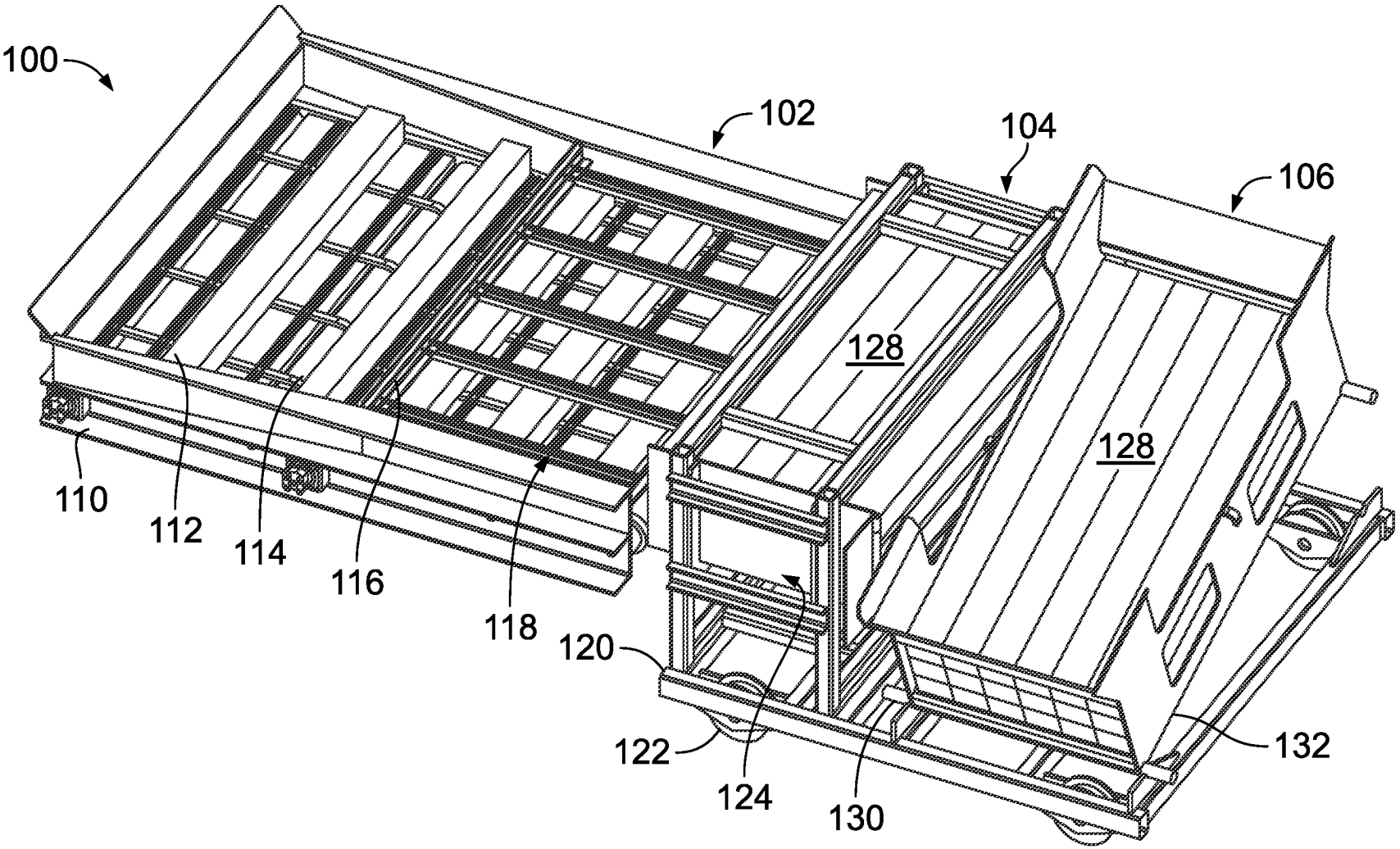
FIG. 1 is a perspective diagram that illustrates one example of a handling system.

Embodiments of the subject matter disclosed herein relate to a system for handling rail ties for rail tracks, and an associated method. In one embodiment, a rail tie handling system is provided that includes a vehicle platform having a receiving and conveying segment, a bundling segment, and an off-loading or tipping segment; and a controller. The handling system can operate to move rail ties to a bundler, bundle them, and then deposit the rail tie bundles at select locations adjacent to the tracks where they may be desired.

The receiving and conveying segment (referred to hereafter as the conveyor) can receive rail ties. The conveyor can receive the rail ties from nearby vehicles. These vehicles that can supply the rail ties to the conveyor may be hopper cars, flatbed rail cars, trailers, or non-rail vehicles that can maneuver close to the conveyor. Once one or more rail ties are obtained by the conveyor, the conveyor moves the rail ties to the bundler. The conveyor may move the rail ties selectively and/or automatically.

The bundling segment, or bundler, receives rail ties from the conveyor and proceeds to arrange them into a bundle. The bundle may be in the form of a determined number and arrangement of rail ties. The rail ties may be fastened in one embodiment, with a strap, temporary adhesive, connector, or the like. In another embodiment, the bundle is simple a block of stacked rail ties in a determined arrangement (and of a determined number). In one embodiment, the bundle may be six rail ties by six rail ties. In other embodiments, other numbers of rail ties in the column or row may be selected based on end use criteria.

The off-loading or tipping segment, or unloader, receives a bundle from the bunder. The unloader then deposits the bundle in determined location. In one embodiment, the bundler urges the bundle off of the unloader using a movable actuator. Suitable actuators may be powered with pneumatics, hydraulics, electric motors, and the like. Suitable actuators may be a belt conveyor, rollers, a ram/press, and an articulating dump. The actuators may move the bundle in a direction that is about perpendicular to the direction of travel of the handling system. In one embodiment, the articulating dump may operate by raising one side, and/or lowering the other side, so that the bundle slides down the created ramp and off of the unloader. Plural actuator types may be used together in some embodiments. The ramp bottom may include powered or unpowered rollers the axes of which run in parallel with the track and direction of travel of the handler system. That is, they 'roll' perpendicular to the track and facilitate the bundle sliding off the ramp when one side of the ramp is raised. In one embodiment, the ramp may be raised from either side so that the bundle may be selectively delivered to a determined side of the track. In another embodiment, a hinged door may selectively lock when not delivering a bundle to retain the bundle securely on the unloader. In another embodiment, the hinged door may pivotally swing from a top edge such that the bundle may slide underneath the door. In yet another embodiment, the hinged door may pivotally swing from the bottom edge such that the hinged door forms at least part of the ramp to extend the distance at which the bundle drops from track. Other embodiments may have the hinged door open in its middle (forming a top half and bottom half, with the bottom half forming the ramp extension); or, open from a front or back side to swing out of the way of the bundle being delivered.

The controller may communicate with a position device that may provide location information. Location information can include position data on the handling system, as well as the handling system speed, data on the route over which the handling system will travel, and various areas relating to the route. Non-vehicle information may include whether the handling system is in a populated area, such as a city, or in the country. It may indicate whether the handling system is on a bridge, in a draw, in a tunnel, or on a ridge. It may indicate whether the route is following along the bank of a river or near a cliff or hill. Additional information may include which side of the handling system which of these features is on. The controller may actuate the unloader based at least in part on position data obtained by the controller from the position device. During use, the controller may prevent the unloader from spraying a spray composition while in a tunnel or near a structure. As detailed herein, the controller may control the unloader based at least in part on one or more of the foregoing factors.

One or more optional sensors may be provided with the handling system. In one embodiment, the sensor is a camera that is useful for capturing and/or recording visual images. These images may be in the form of still shots, analog video signals, or digital video signals. The signals, particularly the digital video signals, may be subject to compression/decompression algorithms, such as MPEG or HEVC, for example. A suitable camera may capture and record in a determined band of wavelengths of light or energy. For example, in one embodiment the camera may sense wavelengths in the visible spectrum and in another the camera may sense wavelengths in the infrared spectrum. Multiple sensors may be combined in a single camera and may be used selectively based on the application. Further, stereoscopic and 3D cameras are contemplated for at least some embodiments described herein. These cameras may assist in determining distance, velocity, and vectors to predict (and thereby avoid) collision and damage. The collision and damage may be a result of, for example, operation of the unloader.

Other suitable sensors may include proximity sensors (radar, lidar, laser ranging devices, microwave sensors, and the like). These may be placed in a variety of locations but can be useful in the drop zones for bundles among other places. Some sensors may monitor rail ties being delivered to or by the conveyor, and bundles being built by and delivered from the bundler. These may monitor for the simple presence or absence of a rail tie, or may monitor the size, condition, orientation, type, and other aspects in some embodiments.

The term consist, or vehicle consist, refers to two or more vehicles or items of mobile equipment (such as the handling system) that are mechanically or logically coupled to each other. Suitable substitute terminology for consist includes vehicle group, virtual group, swarm, train, platoon, convoy and fleet. By being logically coupled, plural items of mobile equipment are controlled so that controls to move one of the items causes a corresponding movement in the other items in consist, such as by wireless command. An Ethernet over multiple unit (eMU) system may include, for example, a communication system for use transmitting data from one vehicle to another in consist (e.g., an Ethernet network over which data is communicated between two or more vehicles).

During use, the controller responds to sensor and location information, among other types of information, to switch operating modes to selectively control one or more of activating the conveyor, activating the bundler, and activating the unloader. These functions may be done relatively independently of each other, excepting of course that the bundler cannot bundle without a supply of rail ties from the conveyor, and the unloader cannot unload with a bundle from the bundler. However, for example, once a bundle is loaded in the unloader the unloading of the bundle may be controlled by the controller. Unloading may be predicted by an unloading trigger. Suitable triggers may be, for example, that the unloader is positioned adjacent to a determined deposit location for a bundle; a manual request to unload a bundle, a periodic milestone has been reached, and the like. In one embodiment, the unloader unloads as soon as a bundle is received. In another embodiment, the unloader is prevented from unloading unless an 'all clear' or 'all safe' single is provided to the controller.

An optional environmental information acquisition system in communication with the controller may include a camera, a data storage device and/or a communication device, and a battery or other energy storage device. The camera can capture and/or generate image data of a field of view. For example, the field of view may represent a solid angle or area over which the camera can be exposed to the environment and thereby to generate environmental information. The image data can include still images, videos (e.g., moving images or a series of images representative of a moving object), or the like, of one or more objects within the field of view of the acquisition system. In any of the embodiments of any of the systems described herein, data other than image data may be captured and communicated. For example, the system may have sensors for capturing image data outside of the visible light spectrum or a microphone for capturing audio data, a vibration sensor for capturing vibration data, elevation and location data, information relating to the grade/slope, and the surrounding terrain, and so on. Terrain information can include whether there is a hill side, a ditch, or flat land adjacent to the route, whether there is a fence or a building, information about the state of the route itself (e.g., ballast and ties, painted lines, and the like), and information about nearby people, vehicles and structures.

A suitable camera that can send video data via the Internet or another network. In one aspect, the camera can be a digital camera capable of obtaining relatively high quality image data (e.g., static or still images and/or videos). For example, the camera may be an Internet protocol (IP) camera that generates packetized image data. A suitable camera can be a high definition (HD) camera capable of obtaining image data at relatively high resolutions.

The data storage device may be electrically connected to the acquisition system and can store the image data. The data storage device may include one or more computer hard disk drives, removable drives, magnetic drives, read only memories, random access memories, flash drives or other solid state storage devices, or the like. Optionally, the data storage device may be disposed remote from the acquisition system, such as by being separated from the acquisition system by at least several centimeters, meters, kilometers, as determined at least in part by the application at hand.

The communication device may be electrically connected to the acquisition system and can communicate (e.g., transmit, broadcast, or the like) the image data to a transportation system receiver located off-board the acquisition system. Optionally, the image data may be communicated to the receiver via one or more wired connections, over power lines, through other data storage devices, or the like. The communication device and/or receiver can represent hardware circuits or circuitry, such as transceiving circuitry and associated hardware (e.g., antennas), that include and/or are connected with one or more processors (e.g., microprocessors, controllers, or the like).

In one embodiment, the acquisition system includes the camera, the data storage device, and the energy storage device, but not the communication device. In such an embodiment, the acquisition system may be used for storing captured image data for later retrieval and use. In another embodiment, the acquisition system comprises the camera, the communication device, and the energy storage device, but not the data storage device. In such an embodiment, the acquisition system may be used to communicate the image data to the controller or other location for immediate use (e.g., being displayed on a display screen), and/or for storage remote from the acquisition system (this is, for storage not within the acquisition system). In another embodiment, the acquisition system comprises the camera, the communication device, the data storage device, and the energy storage device. In such an embodiment, the acquisition system may have multiple modes of operation, such as a first mode of operation where image data is stored within the acquisition system on the data storage device 106, and a second mode of operation where the image data is transmitted off the acquisition system for remote storage and/or immediate use elsewhere.

A suitable camera may be a digital video camera, such as a camera having a lens, an electronic sensor for converting light that passes through the lens into electronic signals, and a controller for converting the electronic signals output by the electronic sensor into the image data, which may be formatted according to a standard such as MP4. The data storage device, if present, may be a hard disc drive, flash memory (electronic non-volatile non-transitory computer storage medium), or the like. The communication device, if present, may be a wireless local area network (LAN) transmitter (e.g., Wi-Fi transmitter), a radio frequency (RF) transmitter that transmits in and according to one or more commercial cell frequencies/protocols (e.g., 3G or 4G), and/or an RF transmitter that can wirelessly communicate at frequencies used for communications (e.g., at a frequency compatible with a wireless receiver of a distributed power system of a vehicle group; distributed power refers to coordinated traction control, such as throttle and braking, of a train or other rail vehicle consist having plural locomotives or other powered rail vehicle units). A suitable energy storage device may be a lithium-ion battery, air flow battery, a Ni-Mh battery, an alkaline cell, or other device suitable for portable energy storage for use in an electronic device. Another suitable energy storage device, albeit more of an energy provider than storage, include a vibration harvester and a solar panel, where energy may be generated and then provided to the camera.

The acquisition system can include a locator device that generates data used to determine the location of the acquisition system. The locator device can represent one or more hardware circuits or circuitry that include and/or are connected with one or more processors (e.g., controllers, microprocessors, or other electronic logic-based devices). In one example, the locator device is selected from a global positioning system (GPS) receiver that determines a location of the acquisition system, a beacon or other communication device that broadcasts or transmits a signal that is received by another component (e.g., the transportation system receiver) to determine how far the acquisition system is from the component that receives the signal (e.g., the receiver), a radio frequency identification (RFID) tag or reader that emits and/or receives electromagnetic radiation to determine how far the acquisition system is from another RFID reader or tag (e.g., the receiver), or the like. The receiver can receive signals from the locator device to determine the location of the locator device relative to the receiver and/or another location (e.g., relative to the handling system). Additionally or alternatively, the locator device can receive signals from the receiver (e.g., which may include a transceiver capable of transmitting and/or broadcasting signals) to determine the location of the locator device relative to the receiver and/or another location.

The controller may be disposed onboard the handling system and may perform one or more of controlling movement of the vehicle (or propulsion system), movement of maintenance equipment, and operation of the unloader. The controller, or control system, can control operations of the vehicle and propulsion system, such as by communicating command signals to the propulsion system (e.g., motors, engines, brakes, or the like) for controlling output of the propulsion system. That is, the control system can control the movement (or not) of the handling system, as well as its speed and/or direction.

The control system can prevent movement of the handling system responsive to a first data content of the image data and allow movement of the handling system responsive to a different, second data content of the image data. For example, the control system may engage brakes and/or prevent motors from moving the handling system to prevent movement of the handling system, movement of the handling system, or operation of the unloader responsive to the first data content of the image data indicating that a locator tag (such as may be worn by an operator, or otherwise carried by an operator) is located outside the operator cab of the vehicle and to allow movement and operation responsive to the second data content of the image data indicating that the locator tag is located inside the operator cab.

The data content of the image data can indicate that the acquisition system is outside of the operator cab based on a change in one or more parameters of the image data. One of these parameters can include brightness or intensity of light in the image data. For example, during daylight hours, an increase in brightness or light intensity in the image data can indicate that the operator and the acquisition system has moved from inside the cab to outside the cab. A decrease in brightness or light intensity in the image data can indicate that the operator and the acquisition system has moved from outside the cab to inside the cab. Another parameter of the image data can include the presence or absence of one or more objects in the image data. For example, the control system can use one or more image and/or video processing algorithms, such as edge detection, pixel metrics, comparisons to benchmark images, object detection, gradient determination, or the like, to identify the presence or absence of one or more objects in the image data. If the locator tag is inside the cab, then the inability of the control system to detect the object in the image data can indicate that the operator is no longer in the cab or vehicle. But, if the object is detected in the image data, then the control system can determine that the operator is in the cab or vehicle, and not in a deposit zone of the bundle or elsewhere on the handling system. This process may supplement others, such as lock out/tag out processes.

A vehicle system may provide propulsion and mobility to the handling system, in one embodiment. In another embodiment, the handling system may be self-propelled. A suitable vehicle system can be a host of autonomous or semi-autonomous drones. Other suitable vehicle systems can be an automobile, agricultural equipment, high-rail vehicle, locomotive, marine vessel, mining vehicle, other off-highway vehicle (e.g., a vehicle that is not designed for and/or legally permitted to travel on public roadways), and the like. The consist can represent plural vehicles communicatively connected and controlled so as to travel together along a route, such as a track, road, waterway, or the like. The controller may send command signals to the vehicle units to instruct the vehicle units how to move along the route to maintain speed, direction, separation distances between the vehicle units, and the like.

The control system can prevent movement of the vehicles, and thus the handling system regardless of whether it is considered one of the vehicles, that are in the consist responsive to the first data content of the environmental information indicating that the acquisition system is positioned in an unsafe area (or not in a safe area) and to allow movement of the handling systems in the consist responsive to the second data content of the environmental information indicating that the acquisition system is not positioned in and unsafe area (or in a known safe area). Such an embodiment may be used, for example, for preventing handling systems in a consist from moving when an operator, wearing or otherwise carrying the locator tag, is positioned in a potentially unsafe area relative to any of the vehicle units, including the handling system.

In another embodiment of one or more of the systems described herein, the controller may store the image data/environmental information and/or use it locally (e.g., in the vehicle or handling system), or may transmit it to a remote location (e.g., off-vehicle location) based on where the handling system is located. For example, if the handling system is in a yard (e.g., a switching yard, maintenance facility, or the like), the environmental information may be transmitted to a location in the yard. But, prior to the handling system entering the yard or a designated location in the yard, the environmental information may be stored onboard the handling system and not communicated to any location off of the handling system.

Thus, in an embodiment, the system may have a control unit that, responsive to at least one of a location of the acquisition system or a control input, controls at least one of the acquisition system or the transportation system receiver to a first mode of operation for at least one of storing or displaying the video data on board the handling system and to a second mode of operation for communicating the video data off board the handling system for at least one of storage or display of the video data off board the handling system. For example, the control unit may control at least one of the acquisition system or the transportation system receiver from the first mode of operation to the second mode of operation responsive to the location of the acquisition system being indicative of the vehicle being in an unknown area or an unsafe area.

During operation of the handling system and/or location tag outside of a designated area (e.g., a geofence extending around a vehicle yard or other location), the image data generated by the camera may be locally stored in the data storage device of the acquisition system, shown on a display of the vehicle, or the like. Responsive to the handling system entering into the designated area, the controller can switch modes to begin wirelessly communicating the image data to the receiver, which may be located in the designated area. Changing where the image data is communicated based on the location of the handling system can allow for the image data to be accessible to those operators viewing the image data for safety, analysis, or the like. For example, during movement of the handling system outside of the yard, the image data can be presented to an onboard operator, and/or the image data may be analyzed by an onboard analysis system of the handling system to generate environmental information and ensure safe operation of the handling system. Responsive to the handling system entering into the yard, the image data and/or environmental information can be communicated to a central office or management facility for remote monitoring of the vehicle and/or operations being performed near the handling system.

As one example, event data transmission (e.g., the transmitting, broadcasting, or other communication of image data) may occur based on various handling system conditions, geographic locations, and/or situations. The image data and/or environmental information may be either pulled (e.g., requested) or pushed (e.g., transmitted and/or broadcast) from the handling system. For example, image data can be sent from a handling system to an off-board location based on selected operating conditions (e.g., emergency brake application), a geographic location the vicinity of a crossing between two or more routes), selected and/or derived operating areas of concern (e.g., high wheel slip or vehicle speed exceeding area limits), and/or time driven messages (e.g., sent once a day). The off-board location may request and retrieve the image data from specific handling systems on demand.

In one embodiment, the controller obtains, generates, or determines a delivery plan that includes locations to which one or more bundles are to be delivered. The controller may take into account information from databases and sensors, as well as from other sources, to determine how many rail ties may be needed, where they may be needed, when they may be needed, what type(s) of rail ties may be needed, and the like. In one embodiment, the controller may determine if sufficient stocks of rail ties are present in a hopper or flatbed car to accomplish a mission. If the amount is insufficient, the controller may signal for more rail ties to be made available so as to complete a determined task. The control may operate a propulsive system to move the handling system to a determined location. The propulsive system may be external to the handling system chassis and may mechanically couple thereto. For example, a locomotive may couple to the handling system to provide propulsion. The controller may then control the locomotive, or in another embodiment the controller provides information to a locomotive controller, which then operates the locomotive to accomplish the determined task. In one embodiment, the handling system has its own on-board propulsion system. In such a case, the controller may control it to move the handling system as determined.

During operation the controller may monitor sensors, maps, and the like to determine if, once at the proper location, conditions are correct for unloading a bundle. In a non-limiting list of examples, the controller may prevent the unloader from operating in the event that: a bundle would be deposited onto adjacent tracks or a road; a person or vehicle or structure would be contacted by the bundle during its unloading; if the handling system is on a bridge or at a switch or a crossing; if the handling system is in motion; if the handling system is adjacent to a hill or infrastructure that would interfere with the unloading; if the handling system is in a tunnel; and the like.

For a handling system with a bundler that can temporarily couple the rail ties together, the controller can determine if, and to what extent, that feature is activated at the bundler. The controller can monitor the movement of rail ties to the conveyor and can make changes to the operation based at least in part on the rail tie provision. In one embodiment, the controller can monitor the condition of the rail ties. And, in response to determining that the rail ties are faulty, of an incorrect type, are jammed or stuck, or the like may switch operating modes based at least in part on that determination. The controller may attempt to correct the situation or may signal that there is a situation that needs correcting. Once the situation has been corrected, and any operators that may have been present are safe, the controller may restart the delivery plan.

Another feature of the controller that it may make an auditable record of the activities, and related information. For example, it might note the time, type and amount of the bundle delivery at a location. If the bundle is deposited to another vehicle, such as a crane, excavator, dump truck, flatbed truck, or the like (rather than deposited to an area adjacent to the tracks) the controller may facilitate the transfer, prevent unloading unless the conditions are correct, and may note the action for later review.

FIG. 1 illustrates handling system 100 having a control system (not shown in FIG. 1) that can convey, bundle and unload rail ties. The handling system includes a conveyor 102, a bundler 104, and an unloader 106. In the illustrated embodiment, the conveyor is on a first chassis 110, and both the bundler and unloader on a second chassis 120. In alternative embodiments, the segments can all be on a single chassis, individual chassis, or can be grouped so that the conveyor and bundler are on a single chassis and the unloader is on its own chassis. The conveyor receives and conveys a rail tie 112 using a powered roller element 114. At a conveyor pivot shaft 116 an elevatable lift 118 can index and deliver rail ties to increasingly higher rows in the bundler. The bundler is supported by a wheel set 122. In the illustrated embodiment the wheels are steel and adapted to run on rail tracks. A bundler mechanism 124 receives the rail ties from the conveyor and organizes them into stacks to form a bundle 128. An optional fastener (not shown) may wrap them with a cord or band to keep the bundle in form. The bundler mechanism, under direction of the controller, provides the bundle to the unloader. The unloader pivots up from an unloader pivot shaft 130 so that a tipper or unloader ramp 132 can create a slope under a bundle. The bundle responds to the rising ramp by sliding down the slope and off of the unloader onto the wayside.

Figure 2:
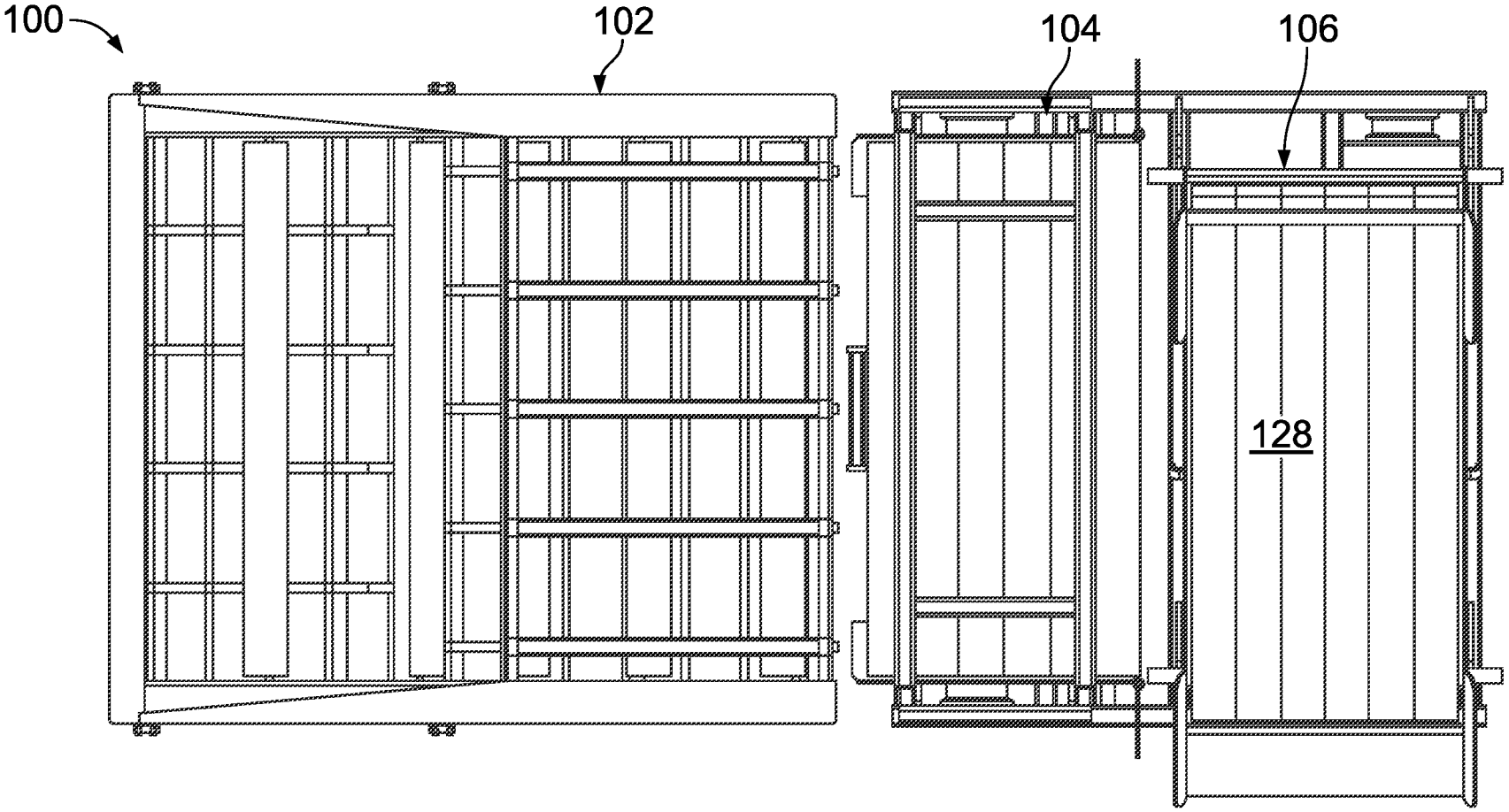
FIG. 2 is a diagrammatic top view of the handling system shown in FIG. 1.
Figure 3:
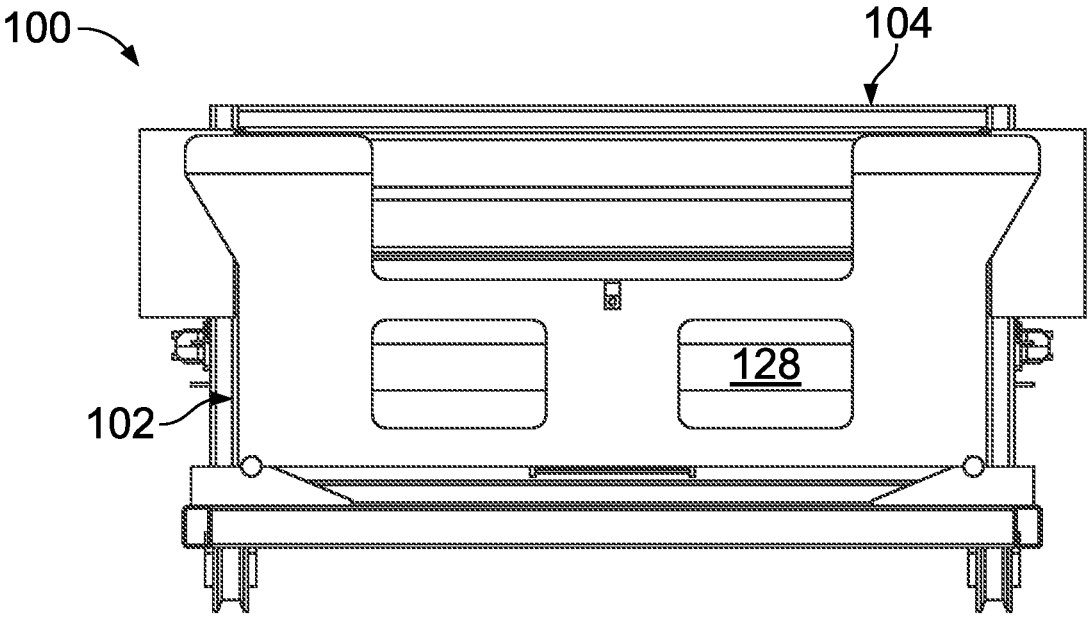
FIG. 3 is a diagrammatic rear view of the handling system show in FIG. 1 with an unloader segment in position to travel with a bundle.
Figure 4:
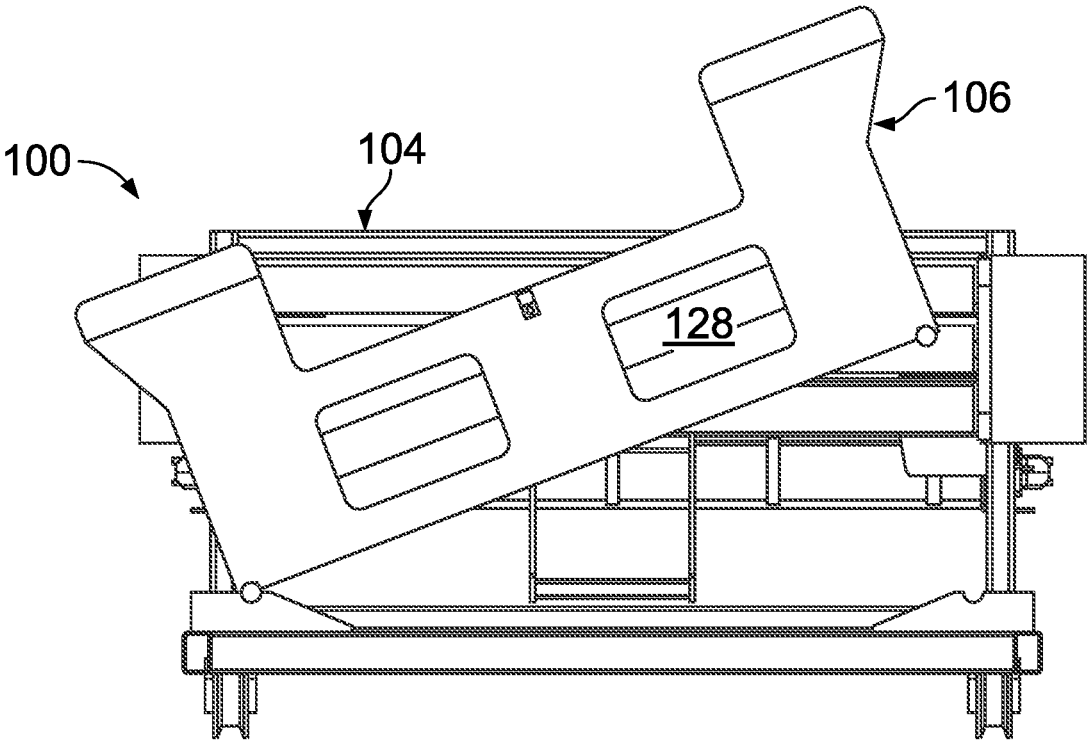
FIG. 4 is a diagrammatic rear view of the handling system show in FIG. 1 with an unloader segment in position to deposit a bundle.

FIGS. 2 through 4 are diagrams showing embodiments of the invention and that illustrate the handling system of FIG. 1 from various perspectives.

In one embodiment, the controllers or systems described herein may have a local data collection system deployed and may use machine learning to enable derivation-based learning outcomes. The controllers may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used making determinations, calculations, comparisons and behavior analytics, and the like.

In one embodiment, the controllers may include a policy engine that may apply one or more policies. These policies may be based at least in part on characteristics of a given item of equipment or environment. With respect to control policies, a neural network can receive input of a number of environmental and task-related parameters. These parameters may include, for example, operational input regarding operating equipment, data from various sensors, location and/or position data, and the like. The neural network can be trained to generate an output based on these inputs, with the output representing an action or sequence of actions that the equipment or system should take to accomplish the goal of the operation. During operation of one embodiment, a determination can occur by processing the inputs through the parameters of the neural network to generate a value at the output node designating that action as the desired action. This action may translate into a signal that causes the handling system to operate. This may be accomplished via backpropagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models is obtained, they may be evaluated on their performance using a determined success metric. The best model is selected, and the controller executes that plan to achieve the desired input data to mirror the predicted best outcome scenario. Additionally, the success metric may be a combination of the optimized outcomes, which may be weighed relative to each other.

Rail ties may be referred to as railroad ties, rail ties, cross ties, and sleepers. While rail ties are disclosed and described herein, other objects of similar nature are contemplated as replacements for the rail ties in certain circumstances. For example, regular lumber may be a substitute for rail ties, as well as rebar, cement barriers, plastic traffic control devices, and the like. Even rail ties may be of different types. Suitable rail tie types can include the traditional wood types, but others can be structural plastics, cement-based, metals (such as steel), and the like. The selection of what objects can be delivered by the inventive system, and therefore within the scope of a 'rail tie' may be determined with reference to application specific parameters. Suitable non-conventional rail ties include Y-shaped ties, twin ties, wide ties, bi-block ties, frame ties, and ladder track, among others. Of note is that some plastic ties are formed from recycled plastic waste materials, whether reinforced or not, and if used provide a useful home for plastic waste.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitries. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

The above description is illustrative and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Other embodiments may be apparent to one of ordinary skill in the art upon reviewing the above description. The scope of the inventive subject matter should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the inventive subject matter and to enable a person of ordinary skill in the art to practice the embodiments of the inventive subject matter, including making and using any devices or systems and performing any incorporated methods. The patentable scope of the inventive subject matter is defined by the numbered claims below, and may include other examples that occur to those of ordinary skill in the art. Such other examples are intended to be within the scope of the claims if they have structural elements that do not differ from the literal language of the claims, or if they include equivalent structural elements with insubstantial differences from the embodiments described by the literal language of the claims.

What is claimed is:

1. A rail tie handling system, comprising:

at least one chassis configured to move along a track;

a conveyor configured to be coupled with the at least one chassis, to receive rail ties, and to provide the rail ties upon demand or request;

a bundler configured to be coupled with the at least one chassis, to receive the rail ties from the conveyor, to bundle the rail ties into a bundle, and to provide the bundle upon demand or request;

an unloader configured to be coupled with the chassis, to receive the bundle from the bundler, and to unload that bundle from the handling system upon demand or request; and a controller configured to determine one or more of when or where to unload the bundle from the unloader.

2. The system of claim 1, wherein the at least one chassis is configured for self-propulsion.

3. The system of claim 1, wherein the at least one chassis is configured for coupling with a vehicle having a propulsion system.

4. The system of claim 1, wherein the at least one chassis is configured for self-propulsion and is configured for coupling with a vehicle having a propulsion system.

5. The system of claim 1, wherein the conveyor is configured to receive the rail ties from at least one of a hopper car, a flatbed rail car, a trailer, or a non-rail vehicle.

6. The system of claim 1, wherein the conveyor comprises a roller or a belt configured to urge the rail ties toward the bundler.

7. The system of claim 6, wherein the roller or belt is coupled to and driven by an electric motor or a pneumatic motor.

8. The system of claim 1, wherein the bundler is configured to lower an arranged first layer of the rail ties received from the conveyor to define a first row of rail ties, the bundler configured to receive an arranged second layer of the rail ties from conveyor on top of the first layer.

9. The system of claim 1, wherein the bundler is configured to temporarily couple the rail ties together in the bundle.

10. The system of claim 1, wherein the unloader is configured to lift at least one edge of a ramp or a tipper having the bundle disposed on the ramp or the tipper to unload the bundle in a direction perpendicular of a travel direction of the handling system onto an area adjacent to the handling system.

11. The system of claim 10, wherein the unloader is configured to lift at least two edges of the ramp or the tipper selectively and one at a time such that the bundle is unloaded perpendicular to the travel direction selectively to either side of the handling system.

12. The system of claim 1, wherein the unloader comprises at least one roller or belt disposed such that the bundle exiting the bundler is received on the roller or belt, the at least one roller or belt configured to facilitate unloading of the bundle and powered such that the at least one roller or belt unloads the bundle from the unloader while operating.

13. The system of claim 1, wherein the unloader comprises at least one hinged door configured to selectively retain the bundle on or in the unloader until the unloader is actuated to unload the bundle.

14. The system of claim 13, wherein the at least one hinged door is configured to pivot downward at a hinge during operation and form a partial ramp configured to deposit the bundle further from the handling system than the bundle would be deposited without the partial ramp.

15. The system of claim 1, wherein the controller is configured to communicate with a location device and to deposit at least one of the bundle at a location determined by the controller based at least in part on location information obtained by the controller from the location device.

16. The system of claim 15, wherein the controller is configured to operate a propulsion system capable of propelling the handling system, the controller configured to direct the handling system to the location using the propulsion system.

17. The system of claim 1, wherein the controller is configured to prevent unloading of the bundle unless one or more determined unloading conditions are met.

18. The system of claim 17, wherein the one or more determined unloading conditions include one or more of:

the bundle would be deposited onto adjacent tracks or a road;

the bundle would contact a person or vehicle or structure during its unloading;

the handling system is on a bridge or at a switch or at a crossing;

the handling system is in motion;

the handling system is adjacent to a hill or infrastructure that would interfere with the unloading the bundle; and the handling system is in a tunnel.

19. A method, comprising:

receiving rail ties at a conveyor on a vehicle chassis;

receiving the rail ties at a bundler from the conveyor;

bundling the rail ties into a bundle using the bundler;

receiving the bundle at an unloader from the bundler;

unloading the bundle via the unloader upon demand or request; and determining one or more of when or where to unload the bundle from the unloader.

20. A rail tie handling system, comprising:

a conveyor configured to receive rail ties, and to provide the rail ties upon demand or request;

a bundler configured to receive the rail ties from the conveyor, to bundle the rail ties into a bundle, and to provide the bundle upon demand or request;

an unloader configured to receive the bundle from the bundler, and to unload that bundle upon demand or request; and a controller configured to determine one or more of when or where to unload the bundle from the unloader.

* * * * *